United States Patent [19]

Gaffal et al.

[11] 4,436,950

[45] Mar. 13, 1984

[54] SYSTEM FOR SEALING PASSAGES IN THE WALLS OF GLANDLESS CIRCULATING PUMPS OR THE LIKE

[75] Inventors: Karl Gaffal, Hessheim; Christian Klepp, Frankenthal, both of Fed. Rep. of Germany

[73] Assignee: Klein, Schanzlin & Becker Aktiengesellschaft, Frankenthal, Fed. Rep. of Germany

[21] Appl. No.: 337,329

[22] Filed: Jan. 6, 1982

[30] Foreign Application Priority Data

Jan. 31, 1981 [DE] Fed. Rep. of Germany ..... 3103299

[51] Int. Cl.[3] ..... H01B 17/30

[52] U.S. Cl. ..... 174/11 BH; 174/18; 174/152 R

[58] Field of Search ..... 174/11 R, 18, 77 R, 174/151, 152 R, 153 R; 310/71, 87; 417/422

[56] References Cited

U.S. PATENT DOCUMENTS

| | | | |
|---|---|---|---|
| 2,651,672 | 9/1953 | Ivanoff | 174/18 X |
| 2,718,543 | 9/1955 | Lidderdale | 174/77 R |
| 4,117,254 | 9/1978 | Richter | 174/18 X |
| 4,227,043 | 10/1980 | Stöhr et al. | 174/151 |

FOREIGN PATENT DOCUMENTS

| | | | |
|---|---|---|---|
| 1294302 | 10/1972 | United Kingdom | 174/152 R |

OTHER PUBLICATIONS (S 3047 0015), Franke, H. F., "Eine Zerlegbare Hochvakuumdichte Hochspannungsdurchführung", *Nuclear Instruments and Methods,* vol. 105, No. 3, Dec. 15, 1972, p. 601.

(S 0349 0094), Schouten, J. A., et al., "Electrical Feedthrough for Gas Pressures up to 10,000 Bar and Low Temperatures", *Review of Scientific Instruments,* vol. 50, No. 12, Dec. 1979, pp. 1652–1653.

*Primary Examiner*—Laramie E. Askin

*Attorney, Agent, or Firm*—Kontler, Grimes & Battersby

[57] ABSTRACT

The passage in a wall which separates the interior of the housing of a glandless submersible motor pump from the surrounding atmosphere is normally sealed by an annular seat which is placed against the end face of a muff forming a detachable part of the wall, and by a temperature- and pressure-resistant ceramic sleeve which surrounds an elongated metallic conductor and normally bears against the seat owing to the pressure differential between the interior of the housing and the surrounding atmosphere. If the sleeve is destroyed, a normally confined plunger of the conductor bears directly against the seat to prevent escape of fluid from the pump housing. That end portion of the conductor which extends into the housing is surrounded by one or more layers of insulating tape and by a tubular sheath which is shrunk onto the tape and exhibits at least some thermal-shock-absorbing characteristics. The plunger bears against an O-ring which prevents leakage of fluid into the space between the peripheral surface of the conductor and the internal surface of the sleeve. Additional O-rings and/or layers of temperature-resistant cement are interposed into the path or paths of potential escape of fluid from the interior of the pump housing.

18 Claims, 1 Drawing Figure

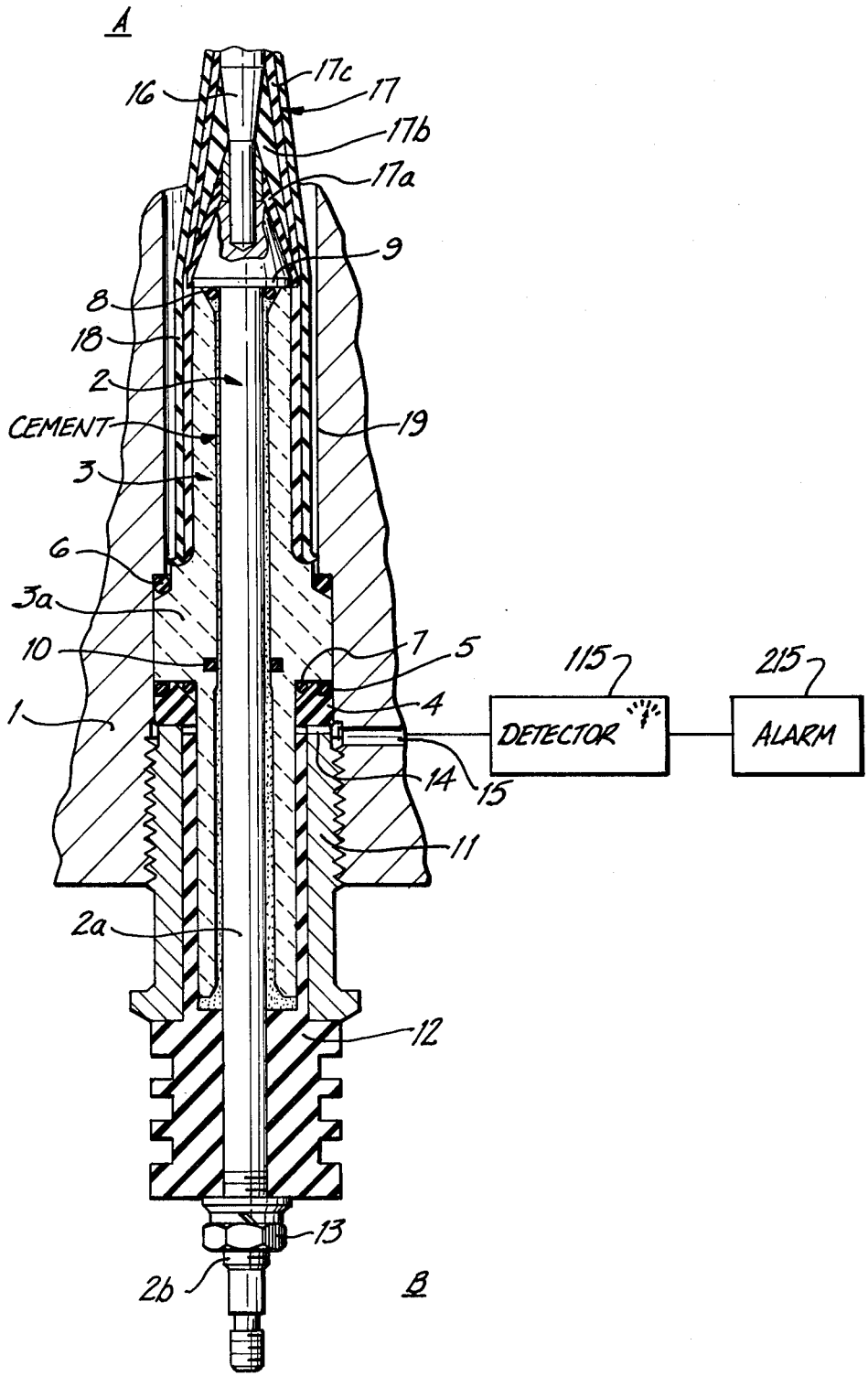
A
16
17c
17
17b
17a
9
8
18
2
CEMENT
19
3
6
3a
10
7
5
115
215
1
4
DETECTOR
ALARM
14
15
11
2a
12
13
2b
B

SYSTEM FOR SEALING PASSAGES IN THE WALLS OF GLANDLESS CIRCULATING PUMPS OR THE LIKE

CROSS-REFERENCE TO RELATED CASES

The system of the present invention constitutes an improvement over and a further development of systems disclosed in commonly owned U.S. Pat. No. 4,227,043 granted Oct. 7, 1980 to Stöhr et al. and in commonly owned copending application Ser. No. 339,071 filed Jan. 13, 1982 by Schneider et al.

BACKGROUND OF THE INVENTION

The present invention relates to pumps or analogous machines in general, and more particularly to improvements in submersible glandless motor pumps and analogous machines which can be used, for example, in nuclear reactor plants to circulate a coolant or another fluid medium. Still more particularly, the invention relates to improvements in systems for sealing the passage which is provided in a wall or the like and serves to allow an electrical conductor to pass from a higher-pressure area at one side of the wall to a lower-pressure area at the other side of the wall, e.g., to connect a motor within the confines of the pump housing with an external source of electrical energy.

The commonly owned copending application Ser. No. 339,071 of Schneider et al. discloses a system wherein an opening or passage in a wall which separates the interior of the housing of a submersible motor pump from the surrounding atmosphere is normally sealed (a) by an annular seat which is placed against a shoulder in the opening or passage and (b) by an insulating sleeve which surrounds an elongated electric conductor serving to connect an external source of electrical energy with a consumer, such as an electric motor in the plenum chamber which is constituted by the housing of the submersible motor pump. The conductor has a larger-diameter portion which is normally embedded in the material of the sleeve but can move into direct sealing engagement with the seat, not unlike the valving element of a check valve, when the sleeve is destroyed so that the pressure differential between the interior of the housing and the surrounding atmosphere can cause the enlarged portion of the conductor to move into sealing engagement with the seat. The seat can constitute a discrete component or an integral part of the wall.

The system of Schneider et al. ensures a highly satisfactory insulating action because it allows for the selection of wall thicknesses of insulators within a wide range. Moreover, the just discussed system renders it possible to ensure the establishment of a reliable sealing action in the event of overheating, i.e., in the event of destruction of the insulating components of the system, because this enables the conductor to move its larger-diameter portion into sealing engagement with the seat in the housing which separates the higher-pressure area from the lower-pressure area. Therefore, the system of Schneider et al. can be used with advantage in, or in combination with, pumps which are employed in nuclear reactor plants where partial damage to or complete destruction of the insulator means should not permit penetration of contaminated fluid into the surrounding atmosphere. Moreover, the system of Schneider et al. can be readily designed in such a way that eventual destruction of insulator means cannot entail any damage to or breakage of the cables which connect the ends of the conductor with a consumer of electrical energy and with a source of electrical energy. Thus, the elasticity and/or length of the cable, which latter must be extended in response to destruction of the insulation and ensuing travel of the larger-diameter portion of the conductor into sealing engagement with the seat, is selected with the view to ensure that such travel of the conductor will not entail any damage to the cable itself and/or to the connection between the cable and the conductor. Still further, the cross-sectional area of the cable and/or conductor and/or insulator can be readily selected in such a way that the insulator is not subjected to excessive mechanical stresses which could entail premature destruction of the insulator as a result of pressure against the seat and/or as a result of pressure of an embedded enlarged portion of the conductor against the surrounding portion of the insulator.

In many instances, e.g., when a glandless circulating pump is used in the boiler of a hydro-cracking reactor, the pressure in the region of the passage between a higher-pressure area and a lower-pressure area can rise to or even above 400 bar. The potential differences can amount to 10,000 volts and the maximum temperature of fluid which is to be confined within the higher-pressure area is determined by permissible temperature of the motor windings (normally in the range of 60° C.).

OBJECTS AND SUMMARY OF THE INVENTION

An object of the invention is to provide a novel and improved system which can be used in lieu of the aforediscussed system of Schneider et al. to even more reliably prevent the escape of fluid from a higher-pressure area into a lower-pressure area in the event of partial damage to or complete destruction of insulating means in the passage between a higher-pressure and a lower-pressure area, especially between the interior of a submersible motor pump and the surrounding atmosphere.

Another object of the invention is to provide a system which, in addition to establishment of a highly satisfactory electrical insulation and sealing action, is capable of standing pronounced thermal shocks without affecting its sealing and/or insulating properties.

A further object of the invention is to provide a system which invariably ensures that elevated pressures at one side of the wall which is provided with a passage for electric conductor means cannot cause expulsion of the conductor means under circumstances which are likely to arise when the system is in use in a submersible motor pump or the like (such circumstances can involve penetration of hot fluid media into the motor housing as a result of leakage in the auxiliary sealing system and resulting short-lasting heating of component parts in the passage to a temperature of up to 350° C.).

Still another object of the invention is to provide a system which ensures that, even in the event of overheating of component parts in the passage between the higher-pressure and lower-pressure areas, the pressure in the terminal box at the lower-pressure end of the conductor in the passage will not rise well above atmospheric pressure (such a terminal box is shown, for example, in FIG. 4 on page 217 of assignee's "Centrifugal Pump Lexicon" published 1975 at Frankenthal, Federal Republic Germany).

The invention resides in the provision of a system for sealing an opening or passage which is provided in a wall (e.g., a portion of the housing of a submersible motor pump) separating a higher-pressure area from a lower-pressure area and serves to allow for the transmission of electrical energy from a source of energy in one of the areas (particularly in the lower-pressure area) to a consumer of electrical energy in the other of the two areas. The system comprises an annular non-magnetic seat which is provided in the passage of the wall and has a predetermined inner diameter, a preferably sturdy elongated metallic conductor extending through the passage and having in the higher-pressure area a portion (e.g., a larger-diameter plunger or piston) with an outer diameter exceeding the predetermined inner diameter of the seat and being urged toward the seat owing to the pressure differential between the two areas, preferably elastic flexible electric cable means connected with an end portion of the conductor in the higher-pressure area (such cable means can connect the conductor with one or more windings of an electric motor in the housing of a submersible motor pump for circulation of coolant in a nuclear reactor plant), a rigid pressure- and temperature-resistant insulating sleeve surrounding the conductor in the passage and bearing against the seat under normal operating conditions (i.e., when the sleeve is intact and prevents direct contact between the plunger of the conductor and the seat), a tubular insulating device (which may consist of one or more layers of convoluted insulating tape) surrounding the plunger of the conductor and a portion of the insulating sleeve in the higher-pressure area, a flexible insulating sheath which sealingly surrounds the tubular insulating device (such sheath can consist of flexible insulating material which is shrunk onto the tubular insulating device), and a sealing element (e.g., an O-ring) interposed between the conductor and the sleeve in the region of the plunger.

The insulating sleeve preferably consists of a suitable ceramic material, and the aforementioned sheath preferably exhibits at least some thermal-shock-intercepting characteristics.

The system preferably further comprises means for urging the insulating sleeve axially of the conductor and toward the plunger. To this end, the conductor can be provided with an externally threaded portion which is remote from the plunger, and the urging means then comprises a tubular insulator which surrounds the conductor between the externally threaded portion and the sleeve and a nut meshing with the externally threaded portion and biasing the tubular conductor against the sleeve so that the latter bears against the plunger of the conductor.

As a rule, the sleeve and the conductor will define at least one path for potential leakage of fluid from the higher-pressure area into the lower-pressure area. In such instances, the system further comprises additional or auxiliary sealing means which is installed in such path to prevent leakage of fluid. The additional sealing means can comprise one or more O-rings and/or at least one layer of temperature-resistant cement, for example, a layer of cement between the periphery of the conductor and the internal surface of the sleeve downstream of the plunger, as considered in the direction of potential flow of fluid from the higher-pressure area toward and into the lower-pressure area.

The wall preferably includes separable first and second portions which are connected to each other by threads. The second portion can constitute a muff having an end face which constitutes a rest or support for the annular seat and is provided with one or more substantially radially extending grooves. The system then further comprises (or can comprise) one or more detector means including means for monitoring the conditions (pressure and/or temperature and/or moisture content) in the groove or grooves of the muff. The first portion of the wall can be provided with a bore in register with one or more grooves in the end face of the muff, and the detector means can be connected with the first portion of the wall to monitor the conditions in the groove or grooves by way of the bore in the first portion of the wall. Alarm means can be operatively connected with the detector means to generate signals when the detected moisture content and/or another characteristic of fluid in the groove or grooves of the muff reaches a predetermined value. Furthermore, the detector means can include a scale or other suitable means for indicating the monitored or measured moisture content and/or another characteristic of the fluid in the groove or grooves of the muff.

The novel features which are considered as characteristic of the invention are set forth in particular in the appended claims. The improved system itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is an axial sectional view of a system which embodies the present invention and whose insulating sleeve is shown in sealing position.

DESCRIPTION OF THE PREFERRED EMBODIMENTS

The drawing shows a system which seals a passage 19 between a higher-pressure area A and a lower-pressure area B, e.g., between the plenum chamber of a submersible motor reactor pump and the surrounding atmosphere. The area A is filled with or contains a normally cold or cool highly pressurized fluid (such as water which is maintained at a temperature of approximately 60° C.). The system comprises an elongated rod-shaped conductor 2 which extends through the passage 19 and whose upper end portion is connected with the adjacent end portion of an electric cable 16 serving to supply electrical energy to the stator winding or windings of an electric motor in the housing of the submersible motor pump. Reference may be had to FIG. 1 of the aforementioned commonly owned copending application Ser. No. 339,071 of Schneider et al. The wall 1 which defines the passage 19 forms part of the pump housing and separates the areas A and B from each other.

An elongated smaller-diameter portion 2*a* of the conductor 2 is surrounded by an insulating sleeve 3 which consists of pressure-and temperature-resistant ceramic material and forms part of the means for normally sealing the passage 19. A tubular insulating device 17 is provided to sealingly surround the cable 16 and the upper part of the insulating sleeve 3 so as to prevent the fluid in the area A from reaching the conductor 2. The device 17 can comprise an innermost layer 17*a* of insulating tape, an intermediate layer 17*b* of insulating tape, and an outermost layer 17*c* of insulating tape. A flexible insulating sheath 18 is shrunk onto the insulating device 17 and cooperates therewith to enhance the sealing action as well as to absorb at least some thermal shocks which, in the absence of components 17 and 18, would be applied to the insulating sleeve 3 in response to overheating of the fluid in the area A.

The sleeve 3 has a larger-diameter portion 3*a* which is snugly received in the corresponding portion of the passage 19 and cooperates with the wall 1, sheath 18 and a primary or foremost sealing element in the form of an O-ring 6 to prevent leakage of pressurized fluid around the portion 3*a* and toward the area B. The portion 3*a* of the sleeve 3 acts not unlike a valving element which bears against an annular seat 4 in the passage 19 to produce a second sealing action downstream of the O-ring 6, as considered in the direction of fluid flow toward the area B. The portion 3*a* normally (i.e., as long as the sleeve 3 is intact) bears against the seat 4 owing to the existence of a pressure differential between the areas A and B. The seat 4 consists of a non-magnetic material and it inner diameter is smaller than the outer diameter of the portion 3*a* of the insulating sleeve 3 so that the portion 3*a* cannot pass therethrough except in response to partial or complete destruction of the sleeve 3.

Furthermore, the inner diameter of the seat 4 is smaller than the diameter of the larger-diameter portion or plunger 9 at the upper end of the conductor 2. This ensures that, even if the sleeve 3 is fully destroyed, the areas A and B remain sealed from each other for reasons which are fully explained in the aforementioned copending application Ser. No. 339,071 of Schneider et al., i.e., the plunger 9 engages the seat 4 and thereby seals the area A from the area B in view of the fact that the pressure at A exceeds the pressure at B.

Total destruction of the insulating sleeve 3 is highly unlikely, especially in view of satisfactory pressure conditions. The wall 1 comprises an internally threaded main portion which defines the major part of the passage 19 and an externally threaded portion or muff 11 which meshes with the internally threaded portion and whose top face constitutes a platform for the seat 4. The muff 11 also consists of non-magnetic material and can be moved with reference to the main portion of the wall 1 to an axial position such that the seat 4 and the larger-diameter portion 3*a* of the insulating sleeve 3 urge the O-ring 6 into requisite sealing engagement with the adjacent part of the main portion of the wall 1, namely, with the part in the region of the lower end portion of the sheath 18.

If the temperature of fluid in the area A rises, even for a relatively short interval of time, beyond the anticipated maximum permissible or acceptable temperature, such rise in temperature can adversely affect the sealing action of the sheath 18, tubular insulating device 17 and O-ring 6. Therefore, the system which is shown in the drawing further comprises auxiliary or secondary sealing means including four O-rings 5, 7, 8 and 10 which are installed in the path of flow of leak fluid from the higher-pressure area A into the lower-pressure area B. Still further, such secondary or auxiliary sealing means may include one or more layers of temperature-resistant cement (indicated by a label) between the external surface of the conductor 2 and the internal surface of the insulating sleeve 3. The O-ring 5 is interposed between the seat 4, main portion of the wall 1 and larger-diameter portion 3*a* of the sleeve 3; the O-ring 7 is interposed between the seat 4 and the larger-diameter portion 3*a* of the insulating sleeve 3; the O-ring 8 is interposed between the plunger 9 of the conductor 2 and the insulation sleeve 3; and the O-ring 10 is interposed between the external surface of the smaller-diameter portion 2*a* of the conductor 2 and the adjacent portion of the sleeve 3. The underside of the plunger 9 can be bonded to the adjacent end face of the sleeve 3 by a layer of heat-resistant cement or the like.

Since the muff 11 is removable from the main portion of the wall 1, the seat 4 is readily accessible for the purpose of inspection or replacement. Furthermore, the provision of a removable mufff 11 renders it possible to gain access to the O-rings 5 and 7 without necessitating even partial dismantling of the remaining components of the improved system. All that is necessary is to remove the muff 11 and the seat 4; this affords access to the O-rings 5 and 7 (these O-rings can be replaced with other types of annular sealing elements).

The upper end face of the muff 11 (namely, that end face which is adjacent to and serves as a platform for the seat 4) is provided with one or more radially extending grooves 14 at least one of which registers with a radially extending bore 15 in the main portion of the wall 1. The bore 15 and the groove or grooves 14 which are in register therewith provide a path for the transmission of signals to one or more monitoring devices 115. For example, the illustrated monitoring device 115 can be designed to monitor the density of the seal between the areas A and B without necessitating even partial dismantling of the improved system (i.e., the device 115 can constitute a pressure gauge which ascertains the presence or absence of leak fluid in the region of the seat 4). Alternatively, or in addition to its pressure monitoring function, the device 115 can serve as a moisture detector which indicates the presence or absence of a liquid in the region of the seat 4 (this is tantamount to detection of leakage of fluid between the areas A and B if the area B is normally dry and the area A is filled with or contains a hydraulic fluid). If desired, the monitoring means 115 can include or can be combined with an alarm device (indicated at 215) which generates for the attendants visible, audible and/or otherwise detectable signals, i.e, which warns the attendants of the existence of at least some leakage of fluid form the area A into the area B. The illustrated monitoring device 115 has a scale and a pointer which indicates the monitored characteristic or characteristics of fluid in the groove or grooves 14.

The lower portion of the conductor 2 (as viewed in the drawing) is externally threaded (as at 2*b*) to take a nut 13 which urges a tubular insulator 12 against the underside of the wall portion or muff 11 and, at the same time, urges the plunger 9 of the conductor 2 against the seal 8 and against the upper end face of the insulating sleeve 3. The conductor portion below the nut 13 is connectable to a second cable which is connected with a suitable source of electrical energy, e.g., in a manner as disclosed in the aforementioned copending application Ser. No. 339,071 of Schneider et al.

The improved system exhibits a number of important and unobvious advantages. Thus, the area A remains sealed from the area B even if the sleeve-like insulator 3 undergoes partial or total destruction. Furthermore, the system can survive pronounced thermal shocks which are likely to destroy and/or damage the auxiliary seals including the O-rings and the layer or layers of cement or other bonding material. It has been found that the aforedescribed system can readily stand thermal shocks within a temperature range of 350° C. which is highly important and advantageous in nuclear reactor plants and analogous installations where leakage of large or even minute quantities of contaminated fluid from the area A into the area B could cause damage to many component parts in the area B, injuries to occupants of the area B and/or prolonged shutdown of the plant wherein the improved system is put to use. Injuries to attendants in the area B and/or damage to equipment in such area in the event of penetration of a hot fluid from the area A into the area B can be caused as a result of contamination of the fluid as well as or exclusively as a result of overheating of the fluid, e.g., as a result of the generation of steam which penetrates from the area A into the area B.

A further important advantage of the improved system is that its components are readily accessible and replaceable in the event of partial or potential damage. Thus, at least some of the auxiliary sealing means can be reached on detachment of the muff 11 from the main portion of the wall 1 (which is a component part of the housing of a submersible motor pump or the like). The sealing ring 6 can be readily inspected upon detachment of the muff 11 and removal of the seat 4, rings 5, 7 and sleeve 3, i.e., without necessitating any major dismantling work upon the machine in which the improved system is put to use. The system can automatically indicate the presence or absence of leakage (note the monitoring means 115) and it can automatically warn the attendants if and when leakage exists (note the alarm means 215).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A system for sealing a passage which is provided in a wall separating a higher-pressure area from a lower-pressure area and serves to allow for the transmission of electrical energy from a source in one of said areas to a consumer in the other of said areas, comprising an annular non-magnetic seat provided in the passage and having a predetermined inner diameter; an elongated conductor adapted to be introduced into said passage from the lower pressure area, said conductor extending through said passage and having in said higher-pressure area a portion with an outer diameter exceeding said predetermined inner diameter and being urged toward said seat owing to the pressure differential between said areas; cable means connected with said conductor in said higher-pressure area; a rigid pressure- and temperature-resistant insulating sleeve surrounding said conductor in said passage and bearing against said seat; a tubular insulating device surrounding said portion of said conductor and a portion of said sleeve in said higher-pressure area; a flexible insulating sheath sealingly surrounding said device; and a sealing element interposed between said conductor and said sleeve in the region of said portion of said conductor.

2. The system of claim 1, wherein said insulating sleeve consists of ceramic material.

3. The system of claim 1, wherein said portion of said conductor includes a plunger.

4. The system of claim 1, wherein said sealing element includes an O-ring.

5. The system of claim 1, wherein said sheath consists of flexible material and is shrunk onto said tubular insulating device.

6. The system of claim 5, wherein said sheath exhibits thermal-shock-intercepting characteristics.

7. The system of claim 1, wherein said conductor has an externally threaded portion and further comprising means for urging said sleeve axially of said conductor and toward said first mentioned portion thereof, including a nut meshing with said second portion of said conductor and a tubular insulator surrounding said conductor intermediate said nut and said sleeve and arranged to bear against said sleeve under the action of said nut.

8. The system of claim 1, wherein said conductor and said sleeve define at least one path for potential leakage of fluid from said higher-pressure area into said lower-pressure area, and further comprising additional sealing means installed in said path to prevent such leakage.

9. The system of claim 8, wherein said additional sealing means comprises at least one O-ring.

10. The system of claim 8, wherein said additional sealing means comprises at least one layer of temperature-resistant cement.

11. The system of claim 10, wherein said layer is provided between said conductor and said sleeve downstream of said portion of said conductor, as considered in the direction of potential flow of fluid from said higher-pressure area into said lower-pressure area.

12. The system of claim 1, wherein said wall includes a first portion and a second portion separable from said first portion, said portions of said wall having mating threads and said second portion having an end face adjacent to said seat, said end face having at least one groove and further comprising detector means including means for monitoring the conditions in said groove.

13. The system of claim 12, wherein said first portion has a bore in register with said groove and said detector means is connected with said first portion of said wall.

14. The system of claim 12, wherein said detector means includes means for monitoring the moisture content of the fluid in said groove.

15. The system of claim 14, further comprising alarm means operatively connected with said detector means and arranged to generate signals when the detected moisture content of fluid in said groove reaches a predetermined value.

16. The system of claim 14, wherein said detector means includes means for indicating the monitored moisture content.

17. The system of claim 1, wherein said wall forms part of the housing of a submersible motor pump.

18. A system for sealing a passage which is provided in a wall separating a higher-pressure area from a lower-pressure area and serves to allow for the transmission of electrical energy from a source in one of said areas to a consumer in the other of said areas, comprising an annular non-magnetic seat provided in the passage and having a predetermined inner diameter; an elongated conductor extending through said passage and having in said higher-pressure area a portion with an outer diameter exceeding said predetermined inner diameter and being urged toward said seat owing to the pressure differential between said areas; cable means connected with said conductor in said high-pressure area; a rigid pressure—and temperature-resistant insulating sleeve surrounding said conductor in said passage and bearing against said seat; a tubular insulating device surrounding said portion of said conductor and a portion of said sleeve in said higher-pressure area; a flexible insulating sheath sealingly surrounding said device; and a sealing element interposed between said conductor and said sleeve in the region of said portion of said conductor, wherein said wall includes a first portion and a second portion separable from said first portion, said portions of said wall having mating threads and said second portion having an end face adjacent to said seat, said end face having at least one groove and further comprising detector means including means for monitoring the conditions in said groove.

* * * * *